United States Patent [19]

Egelhof et al.

[11] 3,945,882

[45] Mar. 23, 1976

[54] STOCK INLET ARRANGEMENT FOR A PAPER-MAKING MACHINE

[75] Inventors: Dieter Egelhof; Karl Wolf, both of Heidenheim-Schnaitheim, Germany

[73] Assignee: J. M. Voith GmbH, Heidenheim, Germany

[22] Filed: Feb. 14, 1974

[21] Appl. No.: 442,594

[30] Foreign Application Priority Data

Feb. 17, 1973 Germany ..... 2307849

[52] U.S. Cl. ..... 162/340; 162/338; 162/336; 162/343

[51] Int. Cl.[2] ..... D21F 1/02

[58] Field of Search ..... 162/340, 343, 338, 336, 162/212, 215, 216, 337

[56] References Cited

UNITED STATES PATENTS

| | | | |
|---|---|---|---|
| 2,688,277 | 9/1954 | Luebke | 162/343 |
| 2,894,581 | 7/1959 | Goumeniouk | 162/343 X |
| 3,061,008 | 10/1962 | Walker | 162/338 |
| 3,351,522 | 11/1967 | Lopas | 162/337 |
| 3,400,044 | 9/1968 | Justus | 162/343 |
| 3,652,392 | 3/1972 | Appel | 162/343 |
| 3,823,062 | 7/1974 | Ward et al. | 162/343 X |

OTHER PUBLICATIONS

Keller, "The Manifold Problem," *Journal of Applied Mechanics*, (Mar. 1949) pp. 77–85.

*Primary Examiner*—Robert L. Lindsay, Jr.
*Assistant Examiner*—Richard V. Fisher
*Attorney, Agent, or Firm*—Michael J. Striker

[57] ABSTRACT

A paper-making machine has a stock supply conduit, a slice, and a pre-slice flow distributing system which communicates with the slice and directs a flow of paper-making stock from the supply conduit to the slice. The system includes a manifold extending longitudinally of the slice, being spaced from the same and having an inlet side through which stock flows from the conduit in direction transversely of the elongation of the manifold. A first side wall of the manifold extends from the inlet side in the flow direction and has a first wall portion which is convex transverse to the flow direction so as to be tangentially approached by the flowing stock and which is formed with a plurality of outlet openings each having a center axis. A second side wall of the manifold is transversely spaced from and extends along the first side wall, having a second side wall portion which is so inclined with reference to the first side wall portion that the direction of flow of stock travelling between and being guided by the side wall portions includes identical angles with the center axes of the respective outlet openings.

9 Claims, 2 Drawing Figures

STOCK INLET ARRANGEMENT FOR A PAPER-MAKING MACHINE

BACKGROUND OF THE INVENTION

The present invention relates to paper-making machines in general, and more specifically to a novel stock inlet arrangement for such a paper-making machine. Still more particularly, the invention is directed to a stock inlet arrangement providing an improved stock distribution for the paper stock that is directed to the slice and there ejected onto a forming wire.

In paper-making machines it is usually essential that the dilute paper stock suspension be as homogenous as possible as it flows to the slice, and that it be flowing at uniform velocity and direction when it is spread onto the forming wire. Unless these requirements can be met, the finished paper will have undesirable variations in its properties, for instance in the form of streaks, in the form of areas in which the fibers are light or sparce, in variations in the sheet strength, and other problems.

Various proposals have been made in the prior art to meet these requirements. One of these involves an apertured distributor roll upstream of the slice. However, rolls of this type will themselves contribute to the development of certain non-uniformities, and it has been found that quite frequently the sheet product will have streaks as the result of eddies passing through the roll or wakes which are created behind the roll as the latter rotate it.

Another approach involves the use of stock distributing pipes which are designed as diffusers. However, because of the use of these pipes the flow path of the paper stock suspension is considerably increased and it has been found that this leads to a flocculation of the fibers. This prior-art construction proposes to employ a flow channel which extends over the width of the machine and is interposed between the distributing pipes and so-called fine pipes. The distributing pipes supply paper stock into the flow channel and from there it must change its flow direction to enter into the fine distributing pipes which supply it to the slice. This results in the production of uncontrolled eddy currents in the flow channel and leads to faulty fiber distribution within the suspension, with a consequent development of the problems that have been outlined earlier.

SUMMARY OF THE INVENTION

Accordingly, it is an object of the present invention to provide an improved stock inlet arrangement for a paper-making machine, which is not possessed of the aforementioned disadvantages.

More particularly, it is an object of the invention to provide such an improved stock inlet arrangement in which optimum flow conditions are established for the paper-making stock.

Another object of the invention is to provide such a stock inlet arrangement which is relatively simple and uncomplicated and which permits the production of paper having a high degree of uniformity.

In keeping with these objects, and with others which will become apparent hereafter, one feature of the invention resides in a stock inlet arrangement for a paper-making machine which, briefly stated, comprises a stock supply conduit and a slice. According to the invention, the arrangement further comprises a pre-slice flow distributing system communicating with the slice for directing a flow of paper-making stock from the supply conduit to the slice. The system includes a manifold which extends longitudinally of the slice spaced therefrom and having an inlet side through which stock flows from the conduit in direction transversely of the elongation of the manifold, a first side wall extending from the inlet side in the flow direction and having a first wall portion which is convex transverse to the flow direction so as to be tangentially impinged by the flowing stock and which is formed with a plurality of outlet openings each having a central axis, and a second side wall transversely spaced from and extending along the first side wall and having a second side wall portion which is so inclined with reference to the first side wall portion that the direction of flow of stock travelling between and provided by the side wall portions includes identical angles with the center axes of the respective outlet openings.

The so-called fine-distributing tubes or pipes will of course be connected with the outlet openings formed in the convex first wall portion, and will be coaxial with these respective outlet openings, their purpose being to forward the paper stock towards the slice.

The present invention is based on the understanding that when the suspension enters the fine-distributing pipes, that is via the outlet openings in the convex first wall portion, there is not only a loss of inlet energy but also a loss of flow energy at the inflow surfaces which is caused by the change of direction of the stock and which is many times greater than the loss of inlet energy. In these circumstances the individual partial currents in the inflow regions, which flow at high velocity, suffer a relatively higher loss of energy than the individual partial currents which flow at a lower velocity. This means that the presence of an additional loss which is brought about by the change of direction forced upon the flowing suspension will bring about a considerable flow equalization. However, since the loss due to change of direction thus makes a considerable contribution to the flow equalization, and since the extent of the loss depends to a very high degree on the angle of deflection which the stock must undergo as it enters the outlet openings, it is of the greatest importance that this angle of deflection should be the same at all of the outlet openings. This means that the change of direction must not be allowed to take place in the manifold upstream of the outlet openings, that is before the flow reaches the outlet openings, because otherwise the desired equalization that results from the deflection loss will be nullified by secondary currents which are known to arise in such a case from the curved flow path obtained. By resorting to the present invention, however, the direction in the change of flow takes place only in the plane of the respective outlet opening, which means that secondary flow currents are suppressed so that an absolutely uniform flow is achieved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
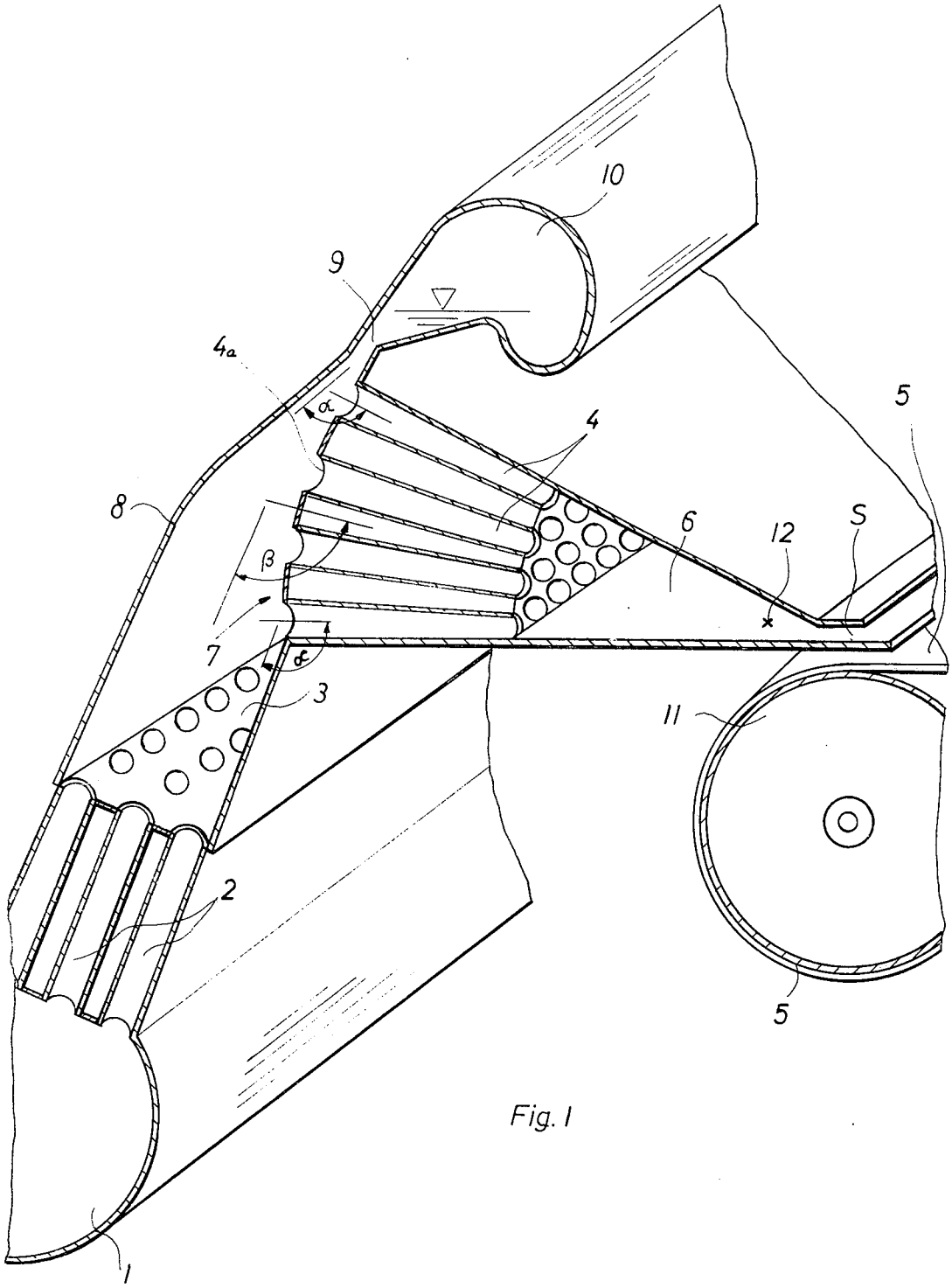
FIG. 1 is a vertically sectioned fragmentary perspective view, illustrating one embodiment of the invention.

Referring firstly to FIG. 1 it will be seen that reference numeral 1 identifies a stock supply conduit through which dilute paper stock is to be supplied to the slice S from where it is deposited upon a forming wire 5 which is trained about and travels around the breast roll 11. The stock supply conduit 1 receives the stock in known manner, that is for instance via a conventional pumping system that is known per se in the paper-making art.

The conduit 1 extends over the entire width of the machine, as of course does the breast roll 11 and the forming wire 5, as well as the slice S. From the conduit 1 extend a plurality of distributing pipes 2 which are arranged side-by-side along the length of the conduit 1 and which communicate with a manifold 3 that also extends over the entire width of the machine. The manifold 3 will be seen to have two transversely spaced side walls which each have initially a straight portion, that is a portion which is straight in the direction of the flow of stock, from the conduit 1 upwardly through the pipes 2 and further upwardly through the manifold 3. In the region of the upper end of the manifold the latter is bounded by side wall portions which are not straight as is the remainder of the side walls. The side wall portion 7 is curved convexly transverse to the direction of flow of the stock, so that the flowing stock will approach the side wall portion 7 tangentially with reference to the curvature of the same. The side wall portion 7 is provided with a plurality of outlet openings 4*a* the center axis of each of which coincides with the longitudinal axis of a fine distributing pipe or tube 4 which communicates with the respective opening 4*a*. The pipes 4 also are arranged over the entire width of the machine, and they all converge in the direction from the respective openings 4*a* towards the slice S. The pipes 2 and the pipes 4 include with one another an angle $\beta$ which may be between substantially 95° and 135°, and the center of curvature of the convex side wall portion 7 is identified with reference numeral 12 and coincides with the point of intersection of the longitudinal axes of the converging pipes 4, although it might be located elsewhere.

The side wall portion 8 which is located opposite the side wall portion 7 is also curved (or may be provided with one or more bends instead of being curved) in such a manner that the flow of stock will include with the center axis of each of the openings 4a and hence the pipes 4 an angle $\alpha$. It is most important according to the present invention that this angle will be the same for all of the openings 4a. In other words, over the entire height of the side wall portion 8, as well as over the entire length thereof (as seen with respect to the width of the machine) the angle included between the center axis of each of the openings 4a and the stream of stock suspension that approaches this opening must always be $\alpha$, and this angle may vary between substantially 105° and 155°. This is obtained by the curvature of the side wall portion 7 and the coordinated curvature (or the provision of bends) of the side wall portion 8.

Past the terminal openings 4*a*, that is the ones which are located uppermost in FIG. 1, the manifold 3 is provided with an overflow 9 through which a portion of the fiber stock may be let off as indicated by the liquid level present in the chamber 10. In the chamber 10 a cushion of compressed gaseous fluid may be established for the purpose of damping the pulsations of the paper stock entering the manifold 3, for instance pulsations caused by the pumping of the paper stock by the non-illustrated pumping system.

Figure 2:
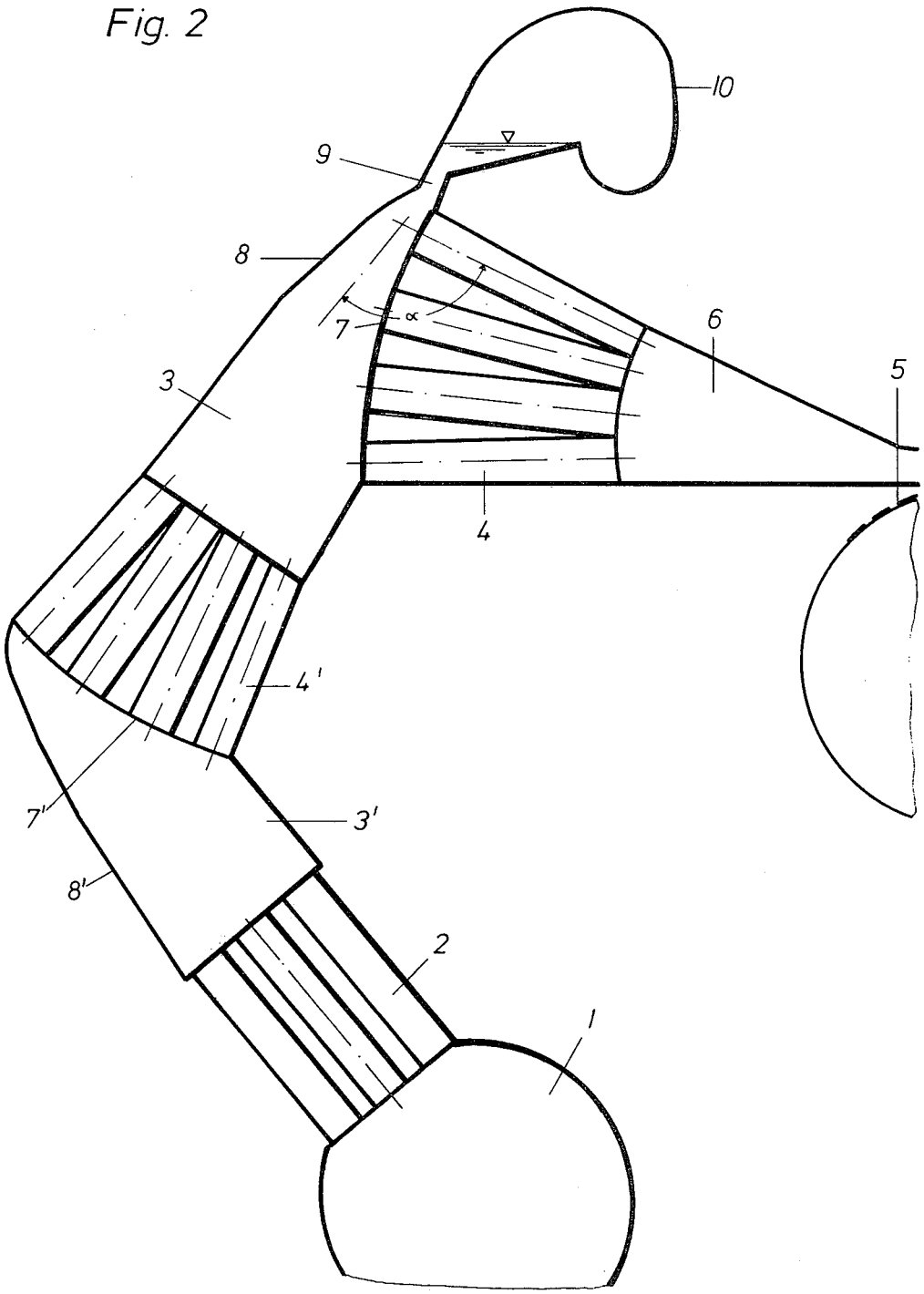
FIG. 2 is a view similar to FIG. 1, but illustrating a further embodiment of the invention.

The embodiment in FIG. 2 is reminiscent of that in FIG. 1, and like reference numerals identify like components. It will therefore not be described in detail, but only insofar as it differs from that of FIG. 1. In FIG. 2, there is provided a further manifold 3′ analogous to the manifold 3 but located between the manifold 3 and the stock supply conduit 1. The manifold 3′ has a side wall portion 7′ corresponding to the side wall portion 7, and a further side wall portion 8′ corresponding to the side wall portion 8. Its outlet openings, which correspond to the openings 4a of FIG. 1, again each communicate with a distributing pipe or tube 4′, but in this case the tubes 4′ converge to a lesser degree than the tubes 4. The tubes 4′ communicate with the manifold 3 which is constructed in all respects in the same manner as in FIG. 1 and of course the remainder of the construction also is the same, that is the manifold 3 discharges into the tubes or pipes 4 which in turn supply the stock to the slice S. The fact that the tubes 4′ converge to a lesser extent than the tubes 4, means that the convex curvature of the side wall portion 7′ is less than that of the side wall portion 7. This arrangement further increases the uniformity of flow and consequently the uniformity of paper which is produced with the machine.

The provision of the overflow 9, which is present in both of the illustrated embodiments, assures that the influence of wall friction in the manifold 3, that is friction between the flowing stock and the walls bounding the manifold, is avoided with respect to the terminal openings 4*a*, that is the ones which are located just before the overflow 9, because the suspension which flows along the side wall portion 8 in this region can now enter into the overflow 9 and thus cannot disadvantageously influence the angle $\alpha$.

The chamber 10 in which the gaseous cushion can be formed, could be omitted if desired but it is advantageous to provide it because of its damping effect.

It will be understood that each of the elements described above, or two or more together, may also find a useful application in other types of constructions differing from the types described above.

While the invention has been illustrated and described as embodied in a stock inlet arrangement for a paper-making machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features which, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A stock inlet arrangement for a paper-making machine, comprising a stock supply conduit; a slice;

and a pre-slice flow distributing system communicating with said slice for directing a flow of paper-making stock from said supply conduit to said slice, said system including a manifold extending longitudinally of said slice spaced therefrom and having an inlet side through which stock flows from said conduit in a direction transversely of the elongation of said manifold, a first side wall extending from said inlet side in said flow direction and having a first side wall portion which is convex transverse to said flow direction so as to be tangentially approached by the flowing stock and which is formed with a plurality of outlet openings each having a center axis, and a second side wall transversely spaced from and extending along said first side wall and having a second side wall portion which is so inclined with reference to said first side wall portion that the direction of flow of stock traveling between and guided by said side wall portions includes identical angles with said center axes of the respective outlet openings.

2. An arrangement as defined in claim 1; and further comprising a plurality of stock distributing tubes each of which communicates with and is coaxial to one of said outlet openings, said tubes converging from said first side wall portion towards said slice.

3. An arrangement as defined in claim 2; further comprising feeding pipes connecting said supply conduit with said inlet side; and wherein said feeding pipes are inclined with reference to the elongation of said tubes.

4. An arrangement as defined in claim 1; further comprising an additional manifold; and an additional pre-slice flow distributing system similar to the first-mentioned one but connecting said additional manifold with said stock supply conduit to supply paper-making stock from the latter to the former.

5. An arrangement as defined in claim 2, wherein said tubes include terminal tubes as seen with reference to the flow direction of stock through said manifold; and wherein said manifold is provided with means defining an overflow which is located past said terminal tubes and extends over the length of said manifold.

6. An arrangement as defined in claim 5; and further comprising walls forming above said overflow means a chamber adapted to accommodate a cushion of compressed gaseous fluid.

7. An arrangement as defined in claim 2, wherein said identical angels formed by said flow direction of stock with said center axes of said respective outlet openings are between substantially 105° and 155°.

8. An arrangement as defined in claim 3, wherein said feeding pipes are inclined with reference to the elongation of said tubes to define an angle between substantially 95° and 135°.

9. A stock inlet arrangement for a paper-making machine, comprising a stock supply conduit; a slice; a pre-slice flow distribution system communicating with said slice for directing a flow of paper-making stock from said supply conduit to said slice, said system including a manifold extending longitudinally of said slice spaced therefrom and having an inlet side through which stock flows from said conduit in a direction transversely of the elongation of said manifold, a first side wall extending from said inlet side in said flow direction and having a first side wall portion which is convex transverse to said flow direction so as to be tangentially approached by the flowing stock and which is formed with a plurality of outlet openings each having a center axis, and a second side wall transversely spaced from and extending along said first side wall and having a second side wall portion which is so inclined with reference to said first side wall portion that the direction of flow of stock travelling between and guided by said side wall portions includes identical angles with said center axes of the respective outlet openings, said identical angles being between substantially 105° and 155°; a plurality of stock distributing tubes each of which communicates with and is coaxial to one of said outlet openings, said tubes converging from said first side wall portion toward said slice; and feeding pipes connecting said supply conduit with said inlet side, said feeding pipes being inclined with reference to the elongation of said tubes so as to define therewith an angle between substantially 95° and 135°.

* * * * *